US005425648A

United States Patent [19]

Farham

[11] Patent Number: 5,425,648

[45] Date of Patent: Jun. 20, 1995

[54] ELECTRICAL CONNECTOR

[76] Inventor: Howden W. Farham, 69 Grey Avenue, Table View, Cape Town, South Africa

[21] Appl. No.: 123,304

[22] Filed: Sep. 17, 1993

[30] Foreign Application Priority Data

Sep. 17, 1992 [ZA] South Africa ..... 92/7119

[51] Int. Cl.[6] ..... H01R 25/16

[52] U.S. Cl. ..... 439/116; 439/676

[58] Field of Search ..... 439/110, 113, 116, 118, 439/122, 207, 310, 347, 353, 670

[56] References Cited

U.S. PATENT DOCUMENTS 2,659,874 11/1953 Veitch ..... 439/132
3,150,908 9/1964 Verrone ..... 439/347
4,032,208 6/1977 Berkanhoff ..... 439/122

*Primary Examiner*—Eugene F. Desmond
*Attorney, Agent, or Firm*—Ladas & Parry

[57] ABSTRACT

An electrical connector 48 for making electrical contact with a conductor track 36 through slots 44 in a channel 26 behind which the conductor track is disposed comprises a pair of tongues 50 which are able to reach through the slots. The tongues each carry conductor pins 114, 116 for establishing electrical contact with the conductor track. The tongues each further carry a jaw 166 which is displaceable in a direction transverse to that in which the tongues are inserted through the slots, between a retracted position in which it is retracted in the tongue and an extended position in which it protrudes laterally from the tongue and engages with the conductor track. Pin wedges 120 displace terminal portions 126 of the conductor pins to make electrical contact with the conductor track.

9 Claims, 18 Drawing Sheets

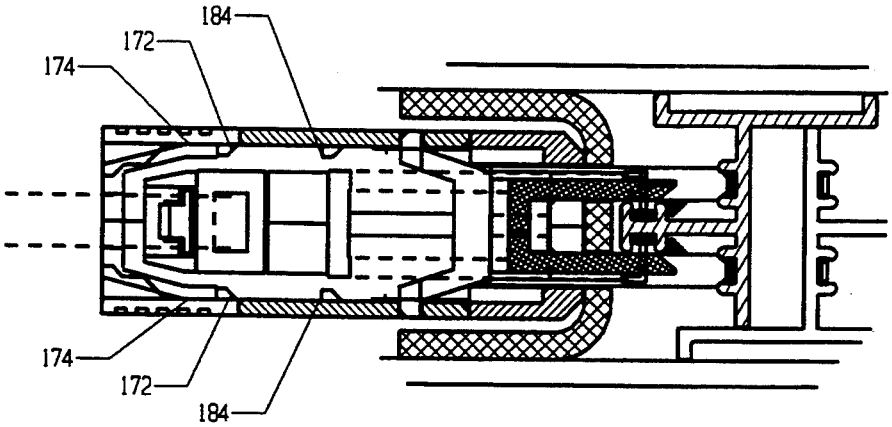
FIG. 18a
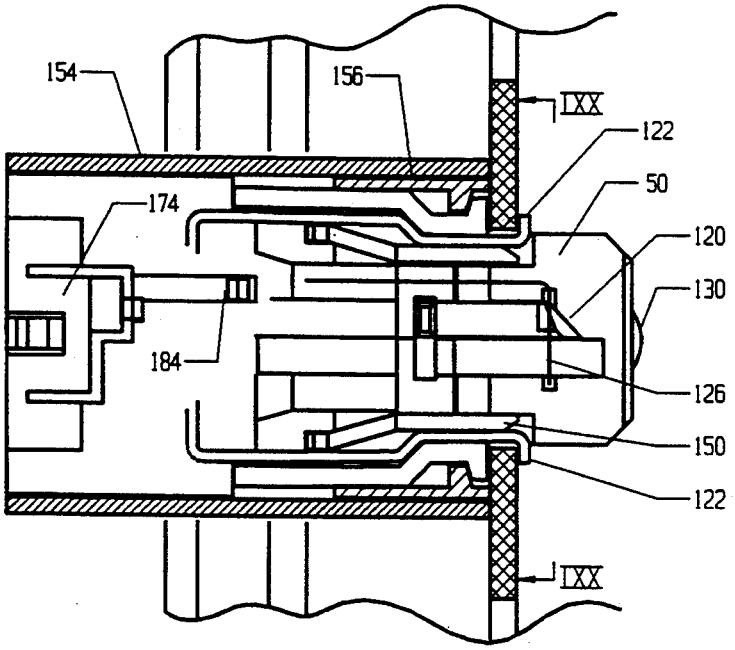
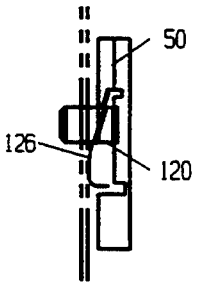
FIG. 19
FIG. 18b

ELECTRICAL CONNECTOR

FIELD OF THE INVENTION

This invention relates to an electrical connector. More particularly it relates to an electrical connector for making electrical contact with a conductor track through openings in a support member behind which the conductor track is disposed.

SUMMARY OF THE INVENTION

According to the invention there is provided an electrical connector for making electrical contact with a conductor track through an opening in a support member behind which the conductor track is disposed, the connector comprising:

a tongue which is able to reach through the opening and carries a conductor pin for establishing electrical contact with the conductor track, the tongue being in use inserted in, or withdrawn from, the opening in a first direction; and a jaw carried by the tongue and being displaceable in a second direction transverse to the first direction, between a retracted position in which it is retracted in the tongue and an extended position in which it protrudes laterally from the tongue, thereby to engage with the conductor track.

The jaw may form part of the bus clamp which is mounted for slidable movement with respect to the tongue in the first direction, a first ramp surface being provided for displacing the jaw from the extended position to the retracted position when the bus clamp is displaced forwardly in the first direction relative to the tngue.

The connector may further comprise biasing means for biasing the bus clamp forwardly with respect to the tongue.

The biasing means may be in the form of a resiliently deflectable cantilever arm.

The connector may further comprise a plunger which is displaceable with respect to the tongue in the first direction and has a forwardly directed face adapted to butt on an outer face of the support member when the tongue is in use inserted into the opening, the plunger being coupled to the bus clamp so that rearward displacement of the plunger with respect to the tongue causes rearward displacement of the bus clamp with respect to the tongue, against the bias provided by the biasing means.

The conductor pin may have a laterally directed terminal portion, the connector further comprising conductor pin displacement means for displacing the terminal portion from a retracted position in which the terminal portion is retracted in the tongue to an extended position in which the terminal portion protrudes laterally from the tongue.

The conductor pin displacement means may be in the form of a pin wedge which is mounted for slidable movement with respect to the tongue in the first direction, a second ramp surface being provided for displacing the terminal portion from the retracted position to the extended position when the conductor pin displacement means is in use displaced forwardly in the first direction with respect to the tongue.

The connector may further comprise a housing which is displaceable with respect to the tongue in the first direction, the housing being coupled to the pin wedge so that forward displacement of the housing with respect to the tongue causes forward displacement of the pin wedge with respect to the tongue.

The connector may further comprise retaining means having a retaining hook for engagement with the support member behind the opening, the retaining hook being displaceable in a third direction transverse to the first direction, and retaining hook displacement means for displacing the retaining hook from a retracted position in which the retaining hook is retracted in the tongue to an extended position in which the retaining hook protrudes laterally from the tongue.

The retaining hook displacement means may comprise a slide link block which is mounted for slidable movement with respect to the tongue in the first direction, a third ramp surface being provided for displacing the retaining hook from the retracted position to the extended position when the retaining hook displacement means is in use displaced forwardly in the first direction with respect to the tongue.

The invention will now be described in more detail, by way of example, with reference to the accompanying drawings.

BRIEF DESCRIPTION OF THE DRAWINGS

In the drawings:

FIGS. 18*a* and 18*b* are horizontal and vertical sections respectively, showing the connector during a final stage of its insertion into the slots; and FIG. 19 is a section on IXX—IXX in FIG. 18*b*.

DETAILED DESCRIPTION OF PREFERRED EMBODIMENT

Figure 1:
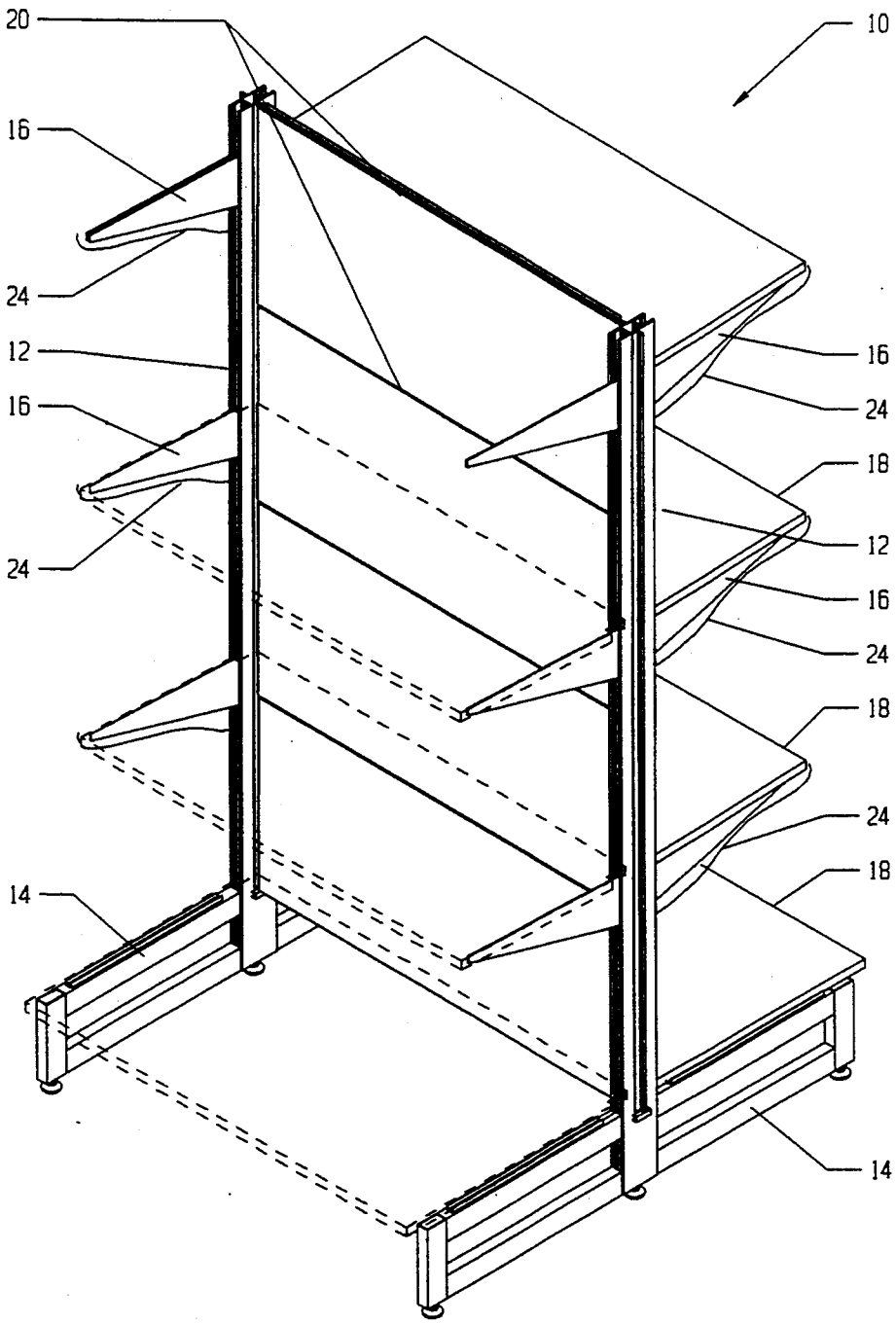
FIG. 1 is a three-dimensional view of a support structure with wiring that makes use of electrical connectors in accordance with the invention.

Referring first to FIG. 1, reference numeral 10 generally indicates a support structure in the form of shelving of the kind used in supermarkets and other self service ships. The structure comprises a series of upright assemblies 12 (only two of which are shown), each mounted on its own base 14, brackets 16 connected to the upright assemblies, shelves 18 supported on the brackets, and, between each pair of adjacent upright assemblies, a series of superimposed back panels 20. The back panels 20 serve to separate the shelves 18 on one side of the structure from the shelves on the other side of the structure, and also provide lateral support for the upright assemblies 12.

Electronic display devices (not shown) for providing information such as, for example, prices of goods, to customers are mounted along the edges of the shelves 18. These devices require power for their operation and must also be connected to a central data processor for the interchange of data with the data processor. This is done by wiring which includes conductor tracks which extend along spaces inside the upright assemblies 12, as will be described in more detail hereinafter, with reference to FIGS. 2 to 4.

The display devices are connected to the conductor tracks by means of cables 24 which each have a connector at the end thereof, in a manner that will be described in more detail hereinafter, with reference to FIG. 4.

Figure 2:
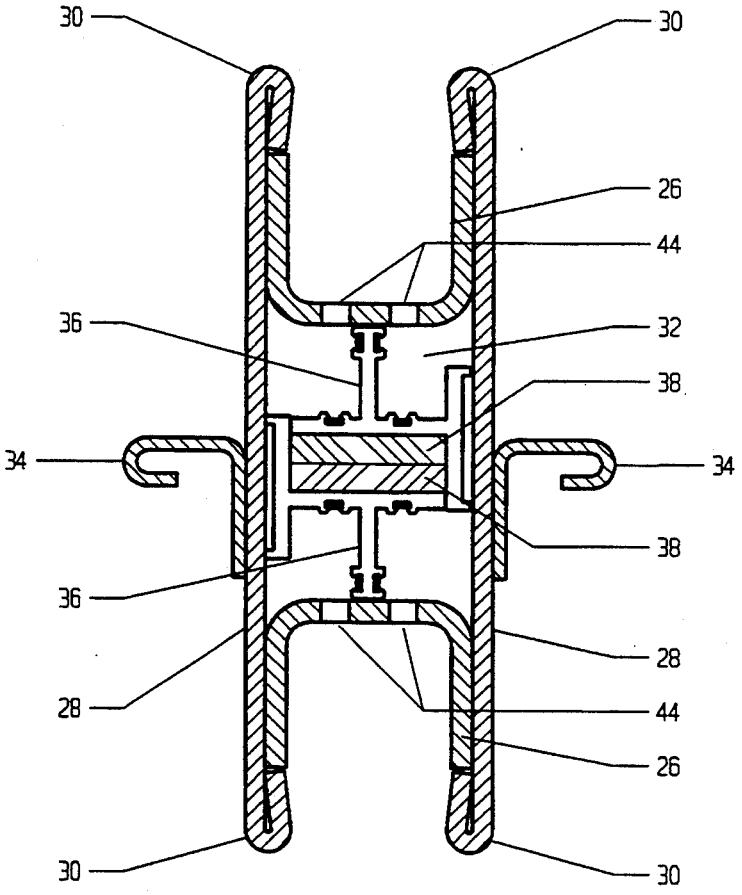
FIG. 2 is a horizontal section through one of the upright assemblies of the support structure, showing conductor tracks inside the assembly.
Figure 3:
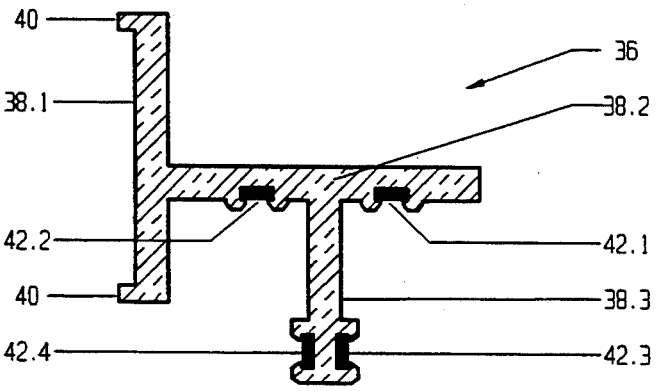
FIG. 3 is a cross-section of one of the conductor tracks.

Referring now to FIG. 2, it will be seen that each upright assembly 12 comprises a pair of slotted U-section channels 26 arranged back-to-back and joined by a pair of side panels 28 with rolled edges 30. The channels 26 and the side panels 28 together define a space 32 which extends along the channels.

Extending along the space 32 there are two conductor tracks 36 arranged back-to-back. One or more compressible foam strips 38 are placed between the conductor tracks. These strips urge the conductor tracks away from one another against the rear faces of the channels 26, and serve to accommodate differences in the spacing between the channels. As can best be seen in FIG. 3, each of the conductor tracks 36 comprises a first portion 38.1 which, when the conductor track is in position in the space 32, lies against a corresponding one of the side panels 28, a second portion 38.2 which extends at right angles to the first portion 38.1, and a third portion 38.3 which extends at right angles to the second portion 38.2.

The first portion 38.1 is provided with a pair of narrow ridges 40 which are easily deformed, and provided to compensate for any variations in the distance between the side panels 28.

In the second portion 38.2 there are a pair of channels accommodating conductors 42.1 and 42.2 respectively, which extend along the length of the conductor track. Likewise, the third portion 38.3 is provided with a pair of channels accommodating conductors 42.3 and 42.4 respectively, which extend along the length of the conductor track.

Figure 4:
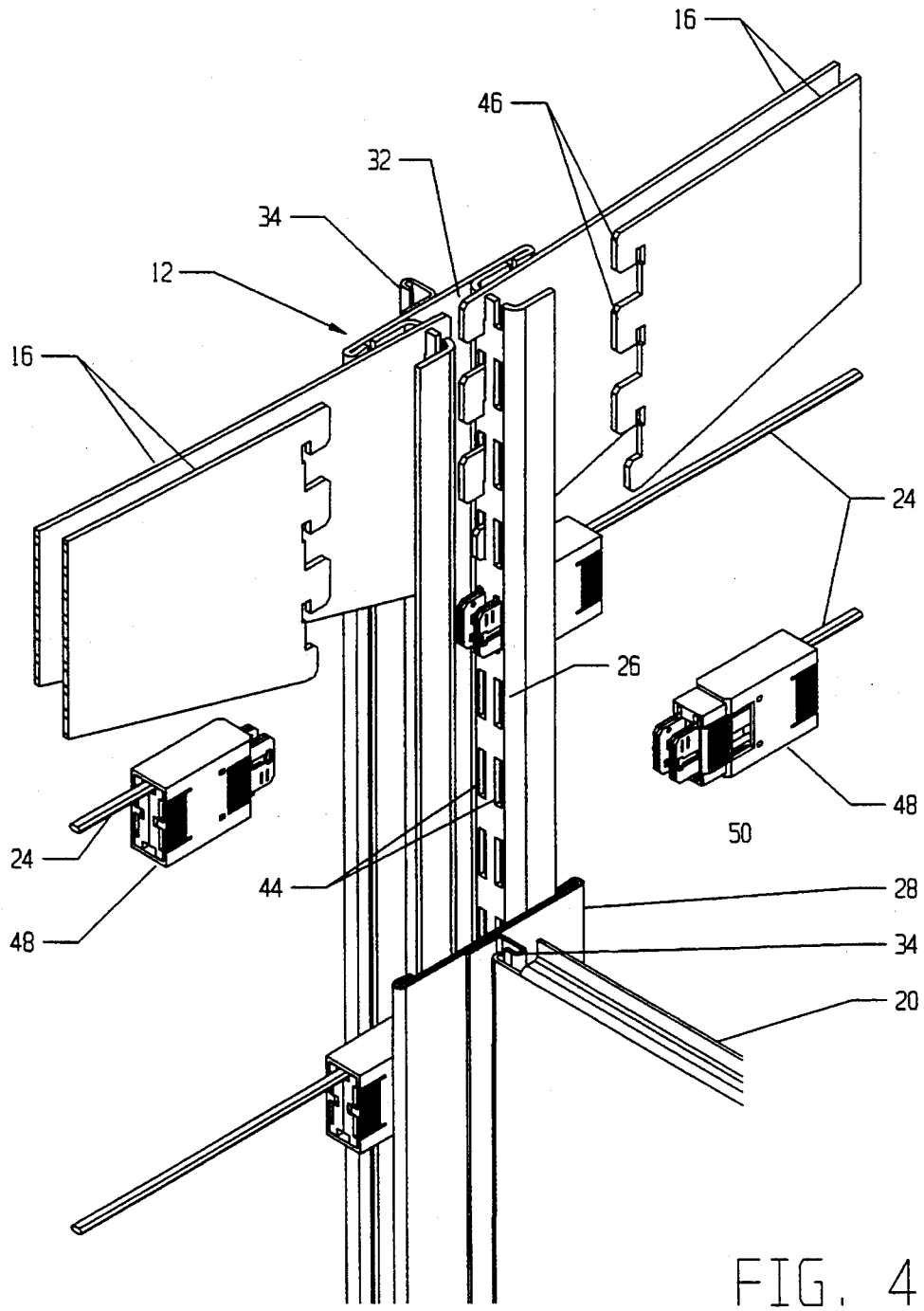
FIG. 4 is an exploded three-dimensional view of various parts of the support structure and the connectors.

Referring now to FIG. 4, it will be seen that each of the channels 26 has two rows of slots 44 therein. The brackets 16 have teeth 46 which can enter via the slots 44 into the space 32, to connect the bracket securely to the channel 26. The arrangement of the conductor tracks 36 is such that they do not interfere with entry of the teeth 46 into the space 32.

The connectors referred to earlier are indicated in FIG. 4 by reference numeral 48. Each of them has a pair of tongues 50 whose size and spacing is such that they can enter through an adjacent pair of the slots 44 into the space 32. The tongues 50 carry conductors whereby electrical contact can be established with the conductors 42.1 to 42.4. The cables 24 are connected to the conductor tracks 36 via the connectors 48.

The conductor tracks 36 are installed by inserting them from the top end into the space 32 and sliding them, with the strip or strips 38 therebetween, down along the space until they are in position. A major advantage of this procedure is that the wiring can be installed without requiring unpacking of the shelves 18, and without the need for installing cable trunking to protect the wiring from damage by goods packed on the shelves or from being pinched between the shelves and the back panels 20 or upright assemblies 12. The conductor tracks are well protected inside the upright assemblies 12.

It will be noted that the conductors 42.3 and 42.4 are relatively close to the channels 26. This will ensure that the teeth 46 do not come into contact with the conductors should the brackets 16 be swung from side to side.

The construction and operation of the connectors 48 will now be described in more detail with reference to the remainder of the drawings.

Figure 5A:
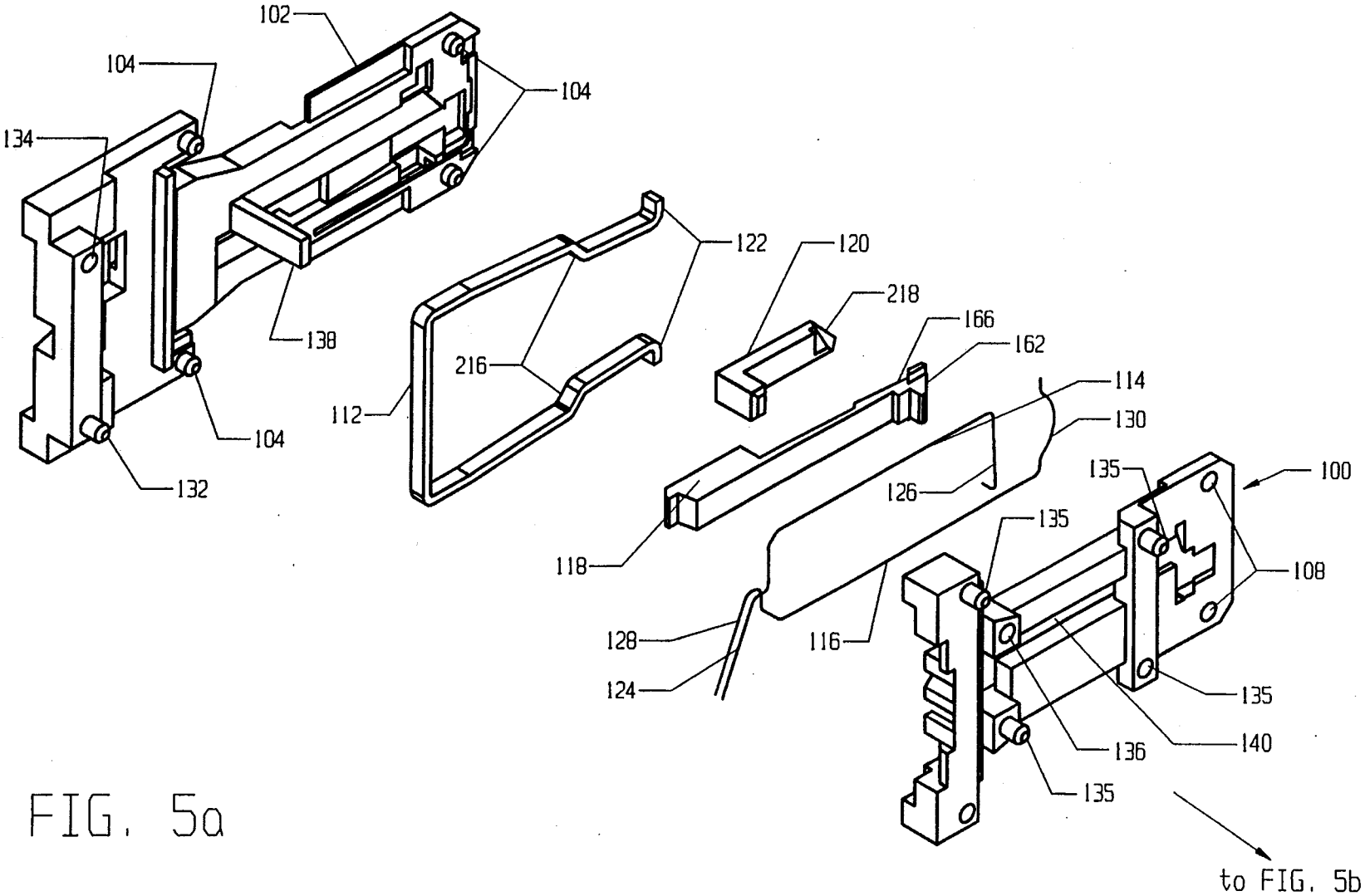
FIGS. 5*a*, 5*b*, and 5*c* are exploded three-dimensional views of the various parts, from left to right through FIGS. 5*a* to 5*c*, of one of the connectors.
Figure 5B:
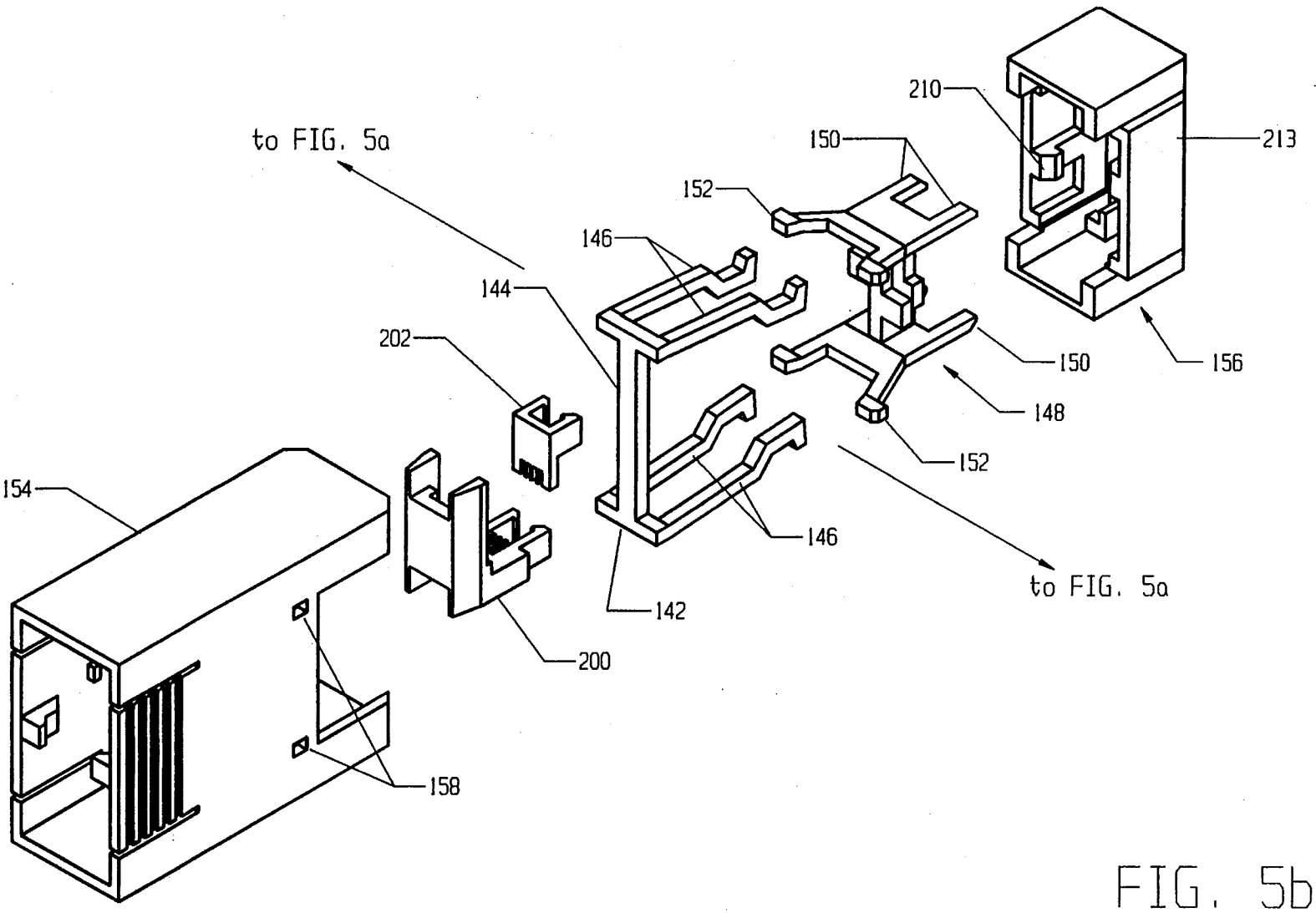
Figure 5C:
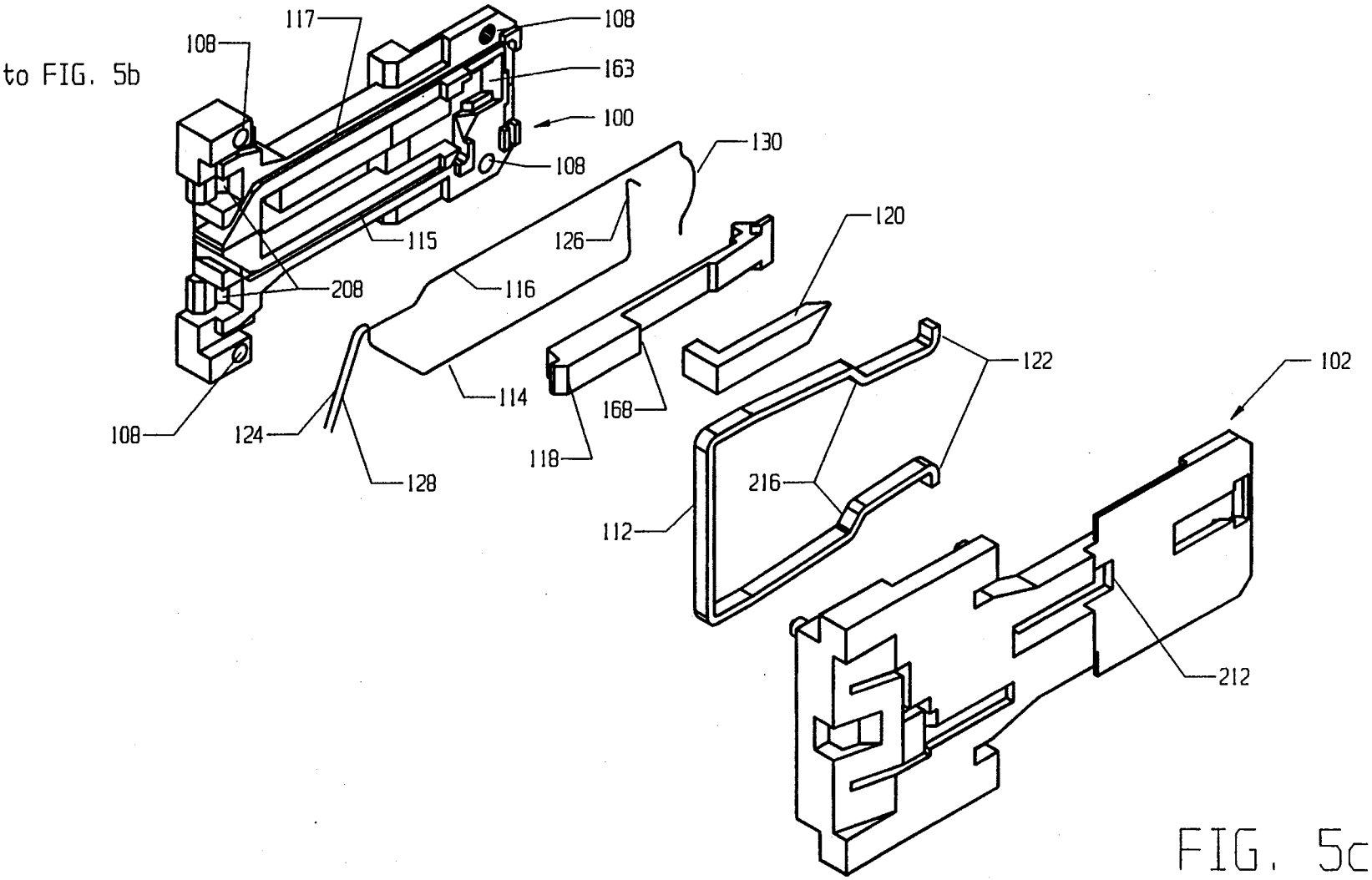
Figure 6:
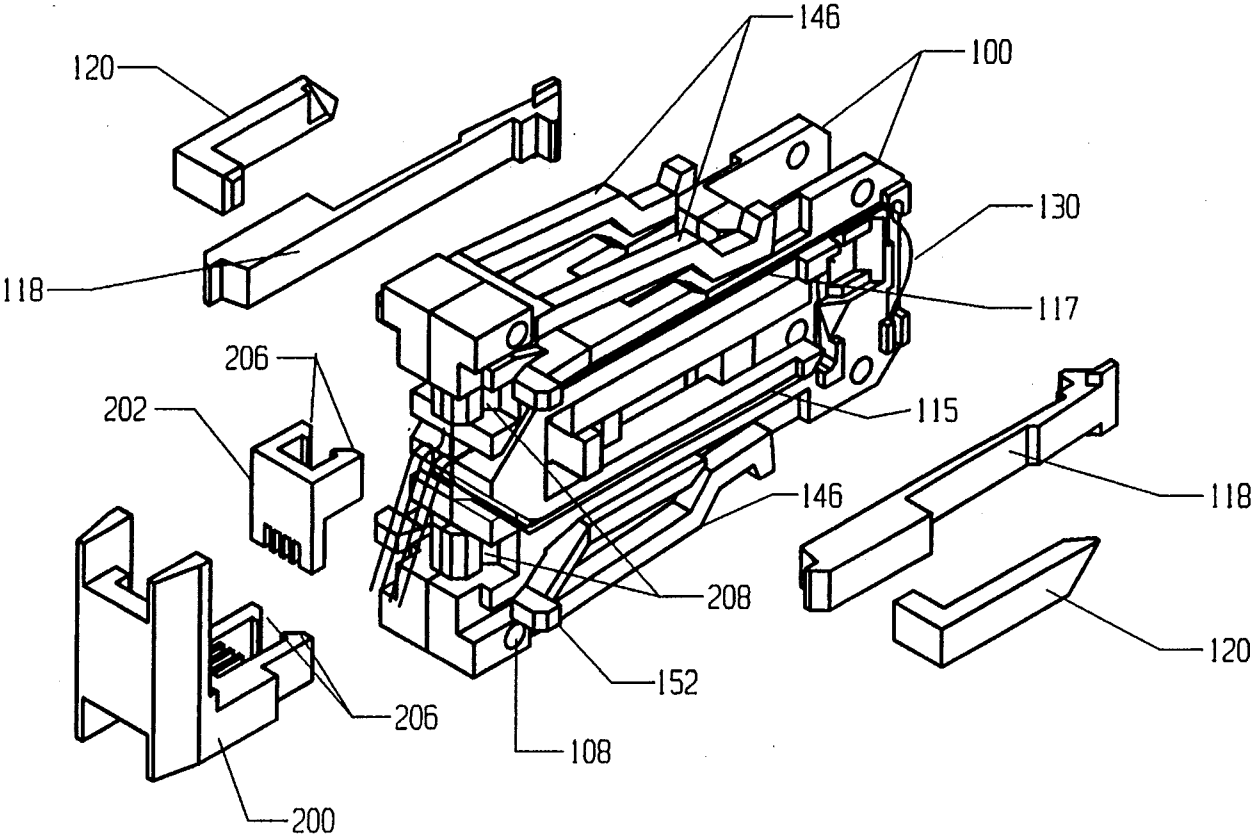
FIGS. 6 to 10 are exploded three-dimensional views showing the connector during various stages of its assembly.
Figure 7:
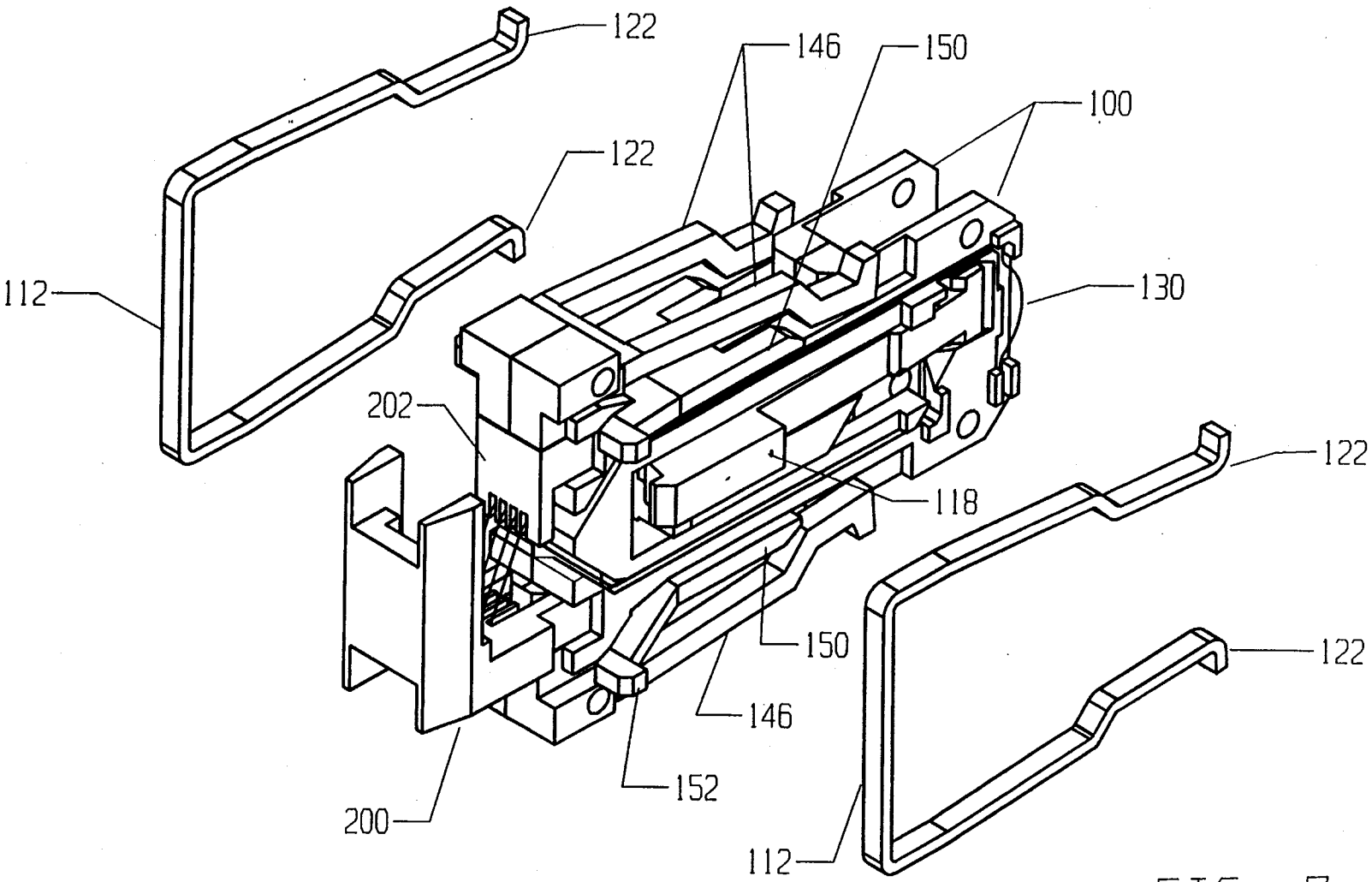
Figure 8:
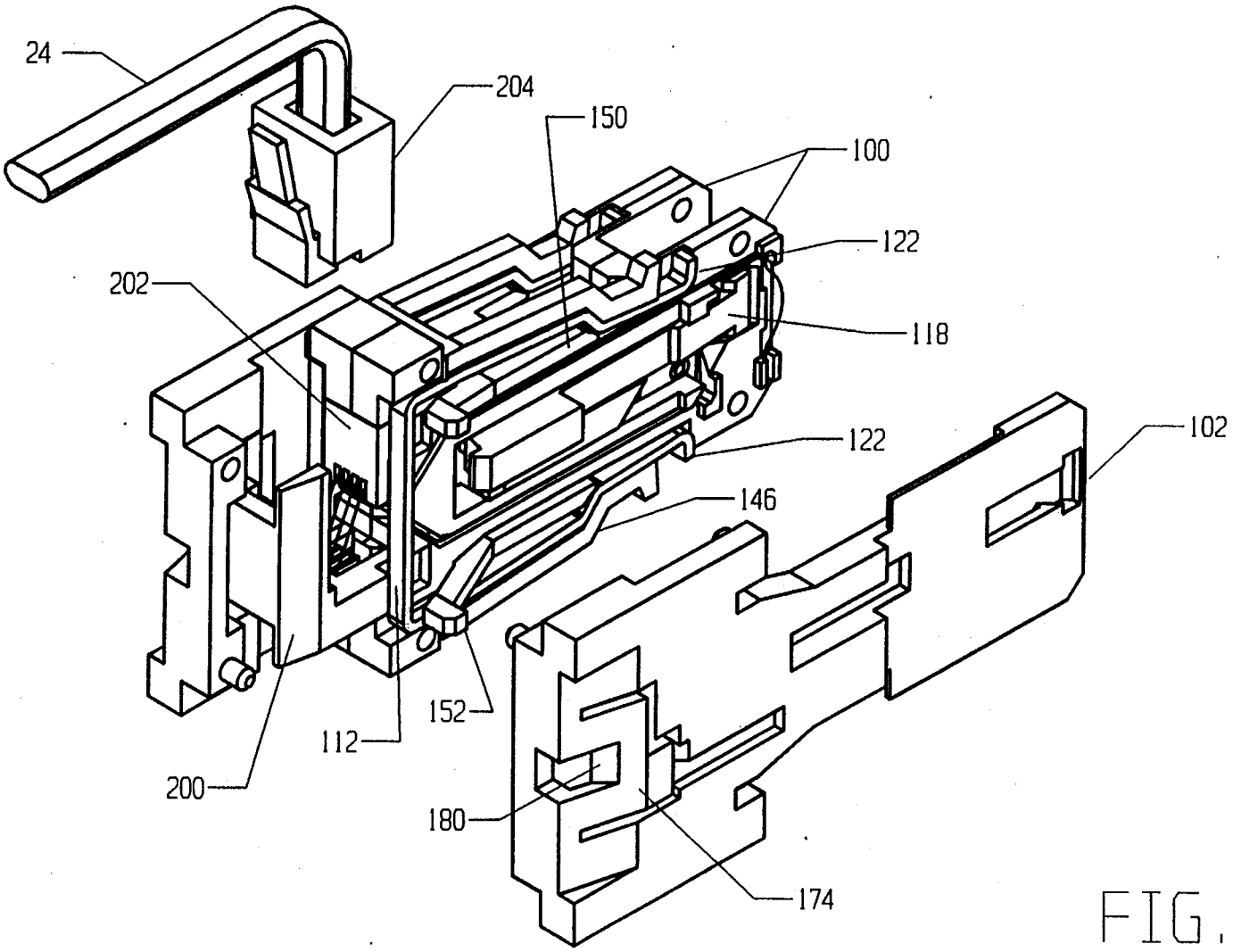
Figure 9:
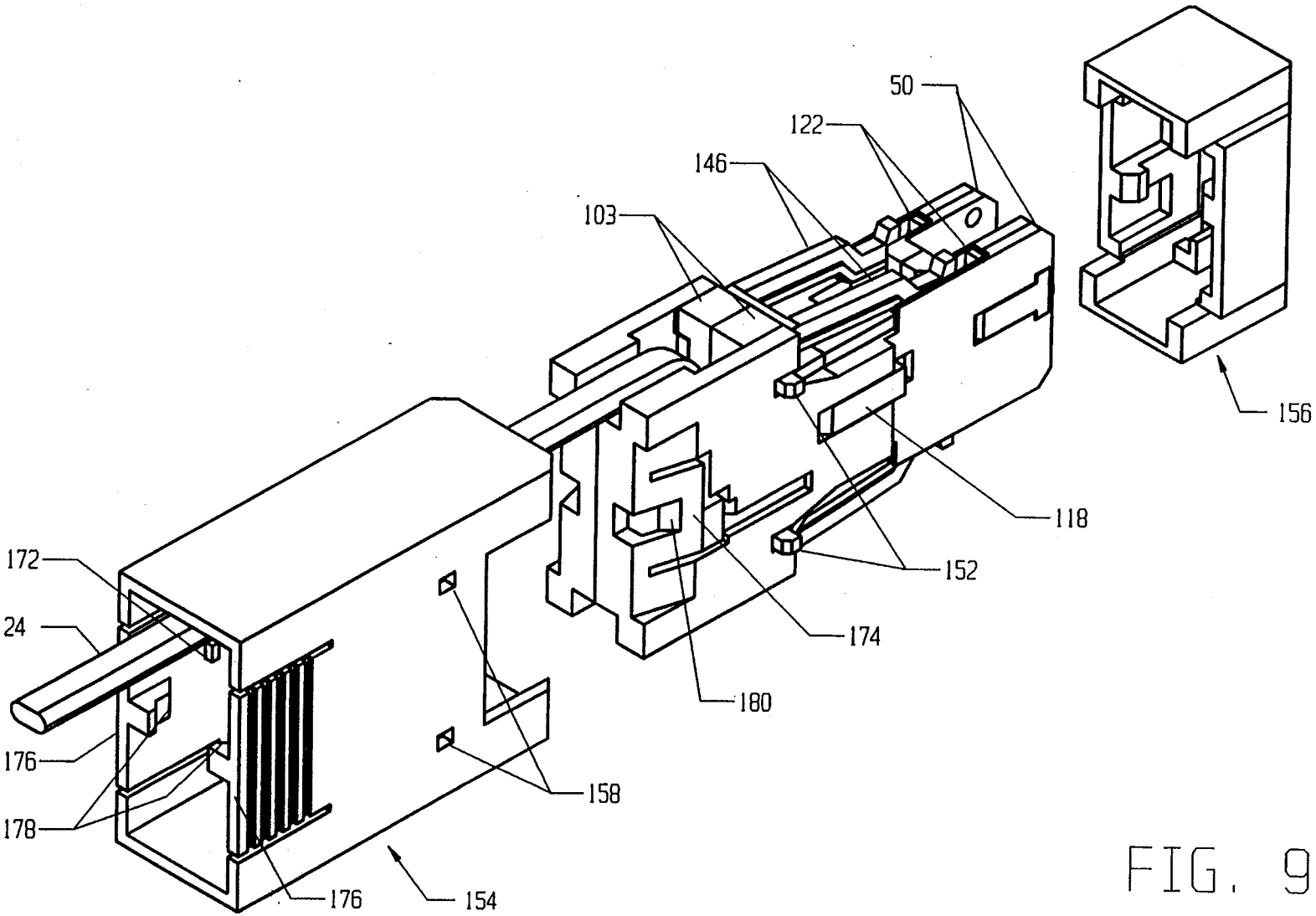
Figure 10:
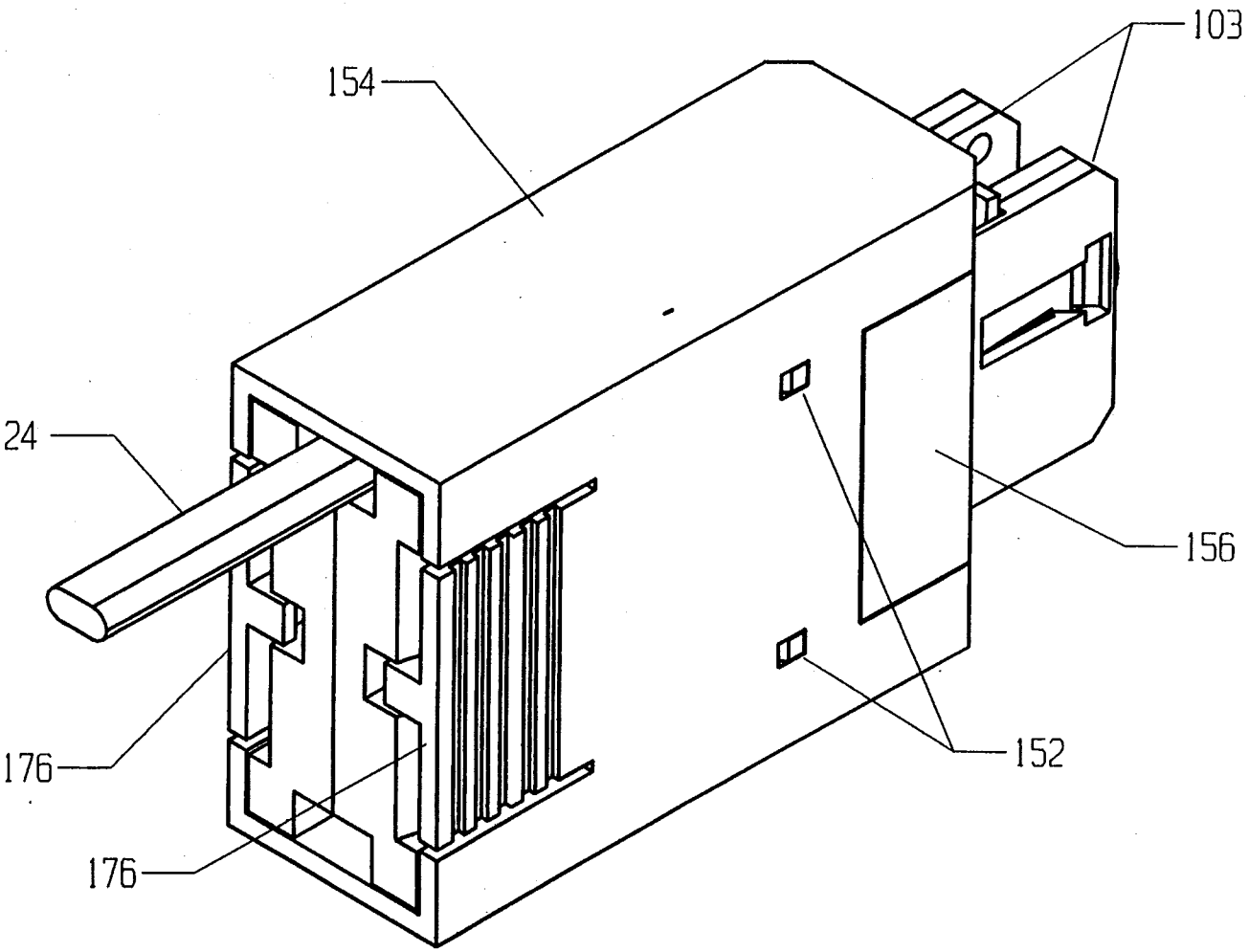
Figure 11:
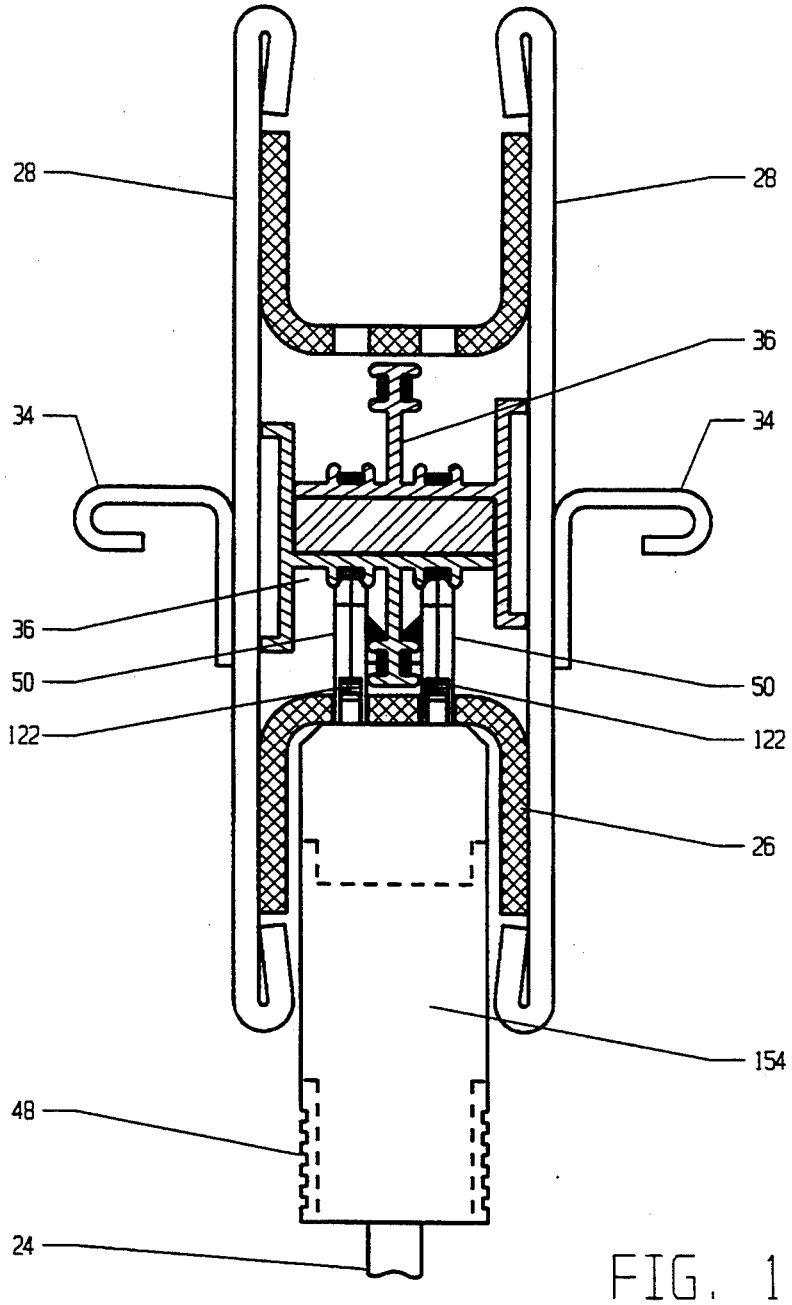
FIG. 11 is a horizontal section through the support structure, showing one of the connectors fully in position.
Figure 12:
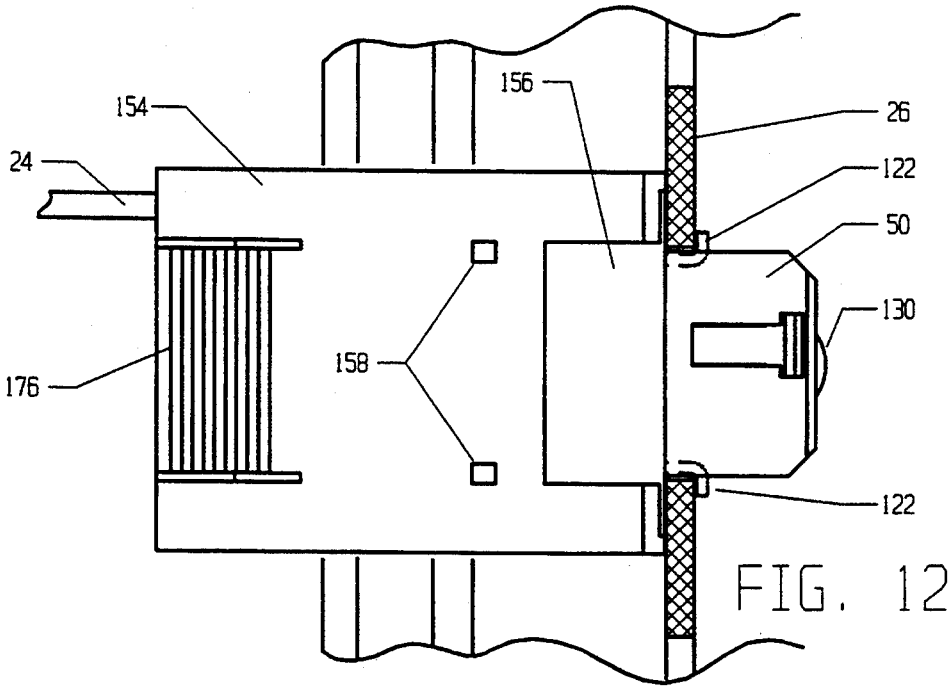
FIG. 12 is a side view of the connector, showing it fully in position in the support structure.
Figure 13:
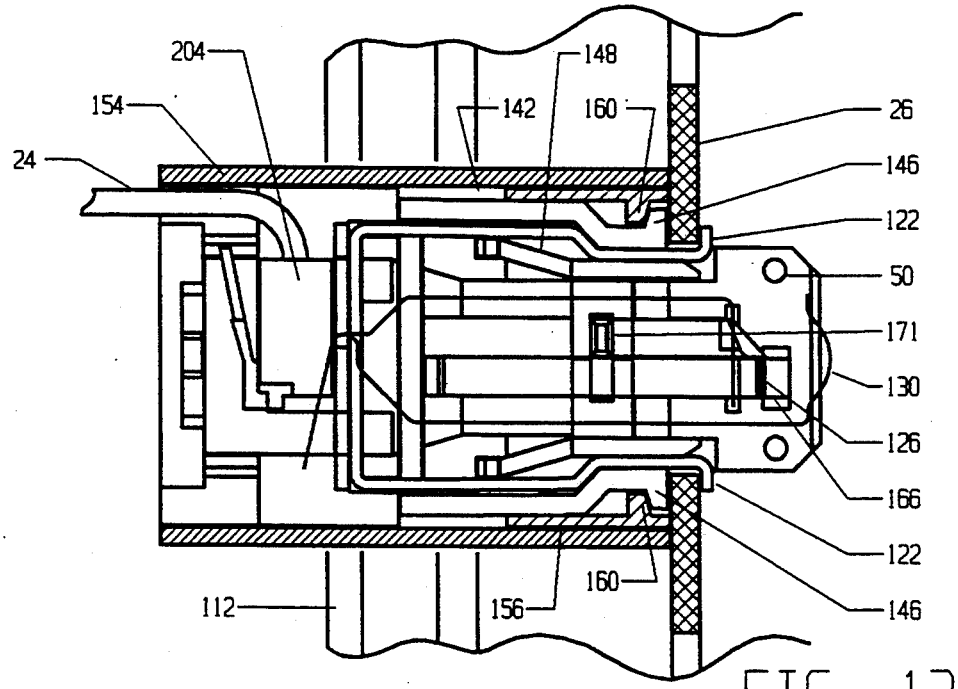
FIG. 13 is a vertical section of the connector, showing it fully in position in the support structure.

Referring first to FIGS. 5*a* to 10, each of the tongues 50 is formed by a pin housing which is made up of two shells, namely an inner shell 100 and an outer shell 102 (FIGS. 5*a* and 5*c*). The shells are moulded from a suitable plastics material. The outer shell 102 has four jointing pins 104 which, during assembly of the connector, enter into holes 108 in the inner shell 100 and are ultrasonically welded to secure the two shells together. Each pair of the shells 100 and 102 then together form a pin housing 103 (FIG. 9). Each of the pin housings 103 houses a spring-steel retaining clip 112, a pair of conductor pins 114 and 116, a bus clamp 118, and a pin wedge 120 (FIGS. 5*a* and 5*c*). In the assembled condition of the connector 48 the conductor pins 114 and 116 are accommodated in channels 115 and 117 respectively, in the inner shells 100 (FIGS. 5*c* and 6).

The retaining clip 112 is U-shaped and has an outwardly directed hook 122 at the free end of each of its limbs. The conductor pin 114 has a rearwardly and downwardly inclined terminal portion 124 at the rear end thereof, and a laterally protruding terminal portion 126 at the front end thereof. The conductor pin 116 has a rearwardly and downwardly inclined terminal portion 128 at rear end thereof, and a forwardly protruding terminal portion 130 at the front end thereof (FIGS. 5*a* and 5*c*).

Each outer shell 102 has a jointing pin 132 and a complemental hole 134 (FIG. 5*a*), whose arrangement is such that, during assembly of the connector, the jointing pin 132 of the one outer shell enters into the hole 134 of the other outer shell and are ultrasonically welded. Furthermore, each inner shell 100 has three jointing pins 135 and a complemental set of holes 136, whose arrangement is such that, during assembly of the connector, the jointing pins 135 of the one inner shell enter into the holes 136 of the other inner shell and are ultrasonically welded.

Each outer shell 102 has a resiliently flexible cantilever arm 138 (FIG. 5*a*) which protrudes through an opening 140 in the corresponding inner shell 100. The connector 48 further comprises a spring lock 142 (FIG.

5*b*) which has a back piece 144 and four forwardly protruding fingers 146; a slide link block 148 which has four forwardly protruding nose elements 150 and four laterally protruding pins 152; a connector housing 154; and a plunger 156. When the connector 48 is in its assembled condition the pins 152 of the slide link block are entered in openings 158 in the connector housing 154.

Finally, the connector 48 comprises components 200 and 202 (FIG. 5*b*) which, in the assembled condition of the connector, form the female part of a standard "RJ9" type electrical connector. The components 200 and 202 have suitable slots therein for receiving and laterally locating the four terminal pins 124 and 128. The connector 48 is thus able to receive a standard "RJ9" type elecrical plug 204 (FIG. 8) connected to the ends of the cables 24.

The components 200 and 202 each have a pair of cantilever clips 206 (FIG. 6) which can engage with corresponding recesses 208 in the inner shells 100. The cantilever clips 206 serve to keep the components 200 and 202, and the inner shells 100 together during assembly, prior to placing the outer shells 102 in position and ultrasonically welding the assembly of inner and outer shells together. Once the outer shells 102 are in place, they firmly hold the components 200 and 202 in position.

To assemble the connector 48 the slide link block 148 is placed in position with respect to the spring lock 142, and the two inner shells 100 assembled with the parts 142 and 148 between them. The components 200 and 202 are clipped in position. The assembly is turned on one side, the conductor pins 114 and 116 on that side dropped into the channels 115 and 117, and the bus clamp 118, pin wedge 120, retaining clip 112, and outer shell 102 on that side placed in position. The assembly is then turned over and the parts on the other side placed in position. The assembly is then placed between the horns of an ultrasonic welding apparatus and the outer and inner shells 100 and 102 welded together. Thereafter the plunger 156 is pushed over the assembly, and hook formations 210 (FIG. 5*b*) which engage behind shoulders 212 (FIG. 5*c*) on the outer shells 102 hold it in position. The plug 204 with cable 24 attached thereto is plugged into the connector formed by the components 200 and 202, finally, the housing 154 is placed in position.

The more detailed construction of the connector 48, and how the various parts thereof co-operate with one another, will become clear from the description which follows. In FIGS. 14*a* to 15*b* the emphasis is on the operation of the jaws 166 of the bus clamps 118, whereas in FIGS. 16*a* to 19 the emphasis is on the operation of the slide link block 148 and the pin wedges 120.

Figure 14A:
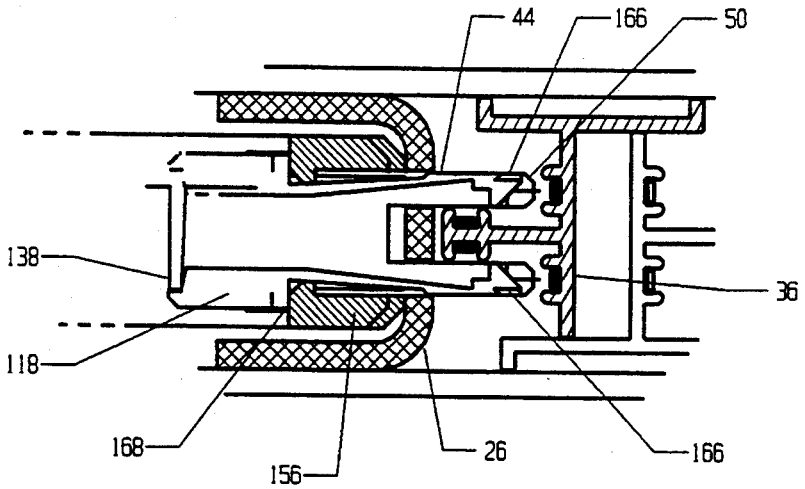
FIGS. 14*a* and 14*b* are horizontal and vertical sections respectively of the connector, showing it during a first stage of its insertion into slots of the support structure.
Figure 14B:
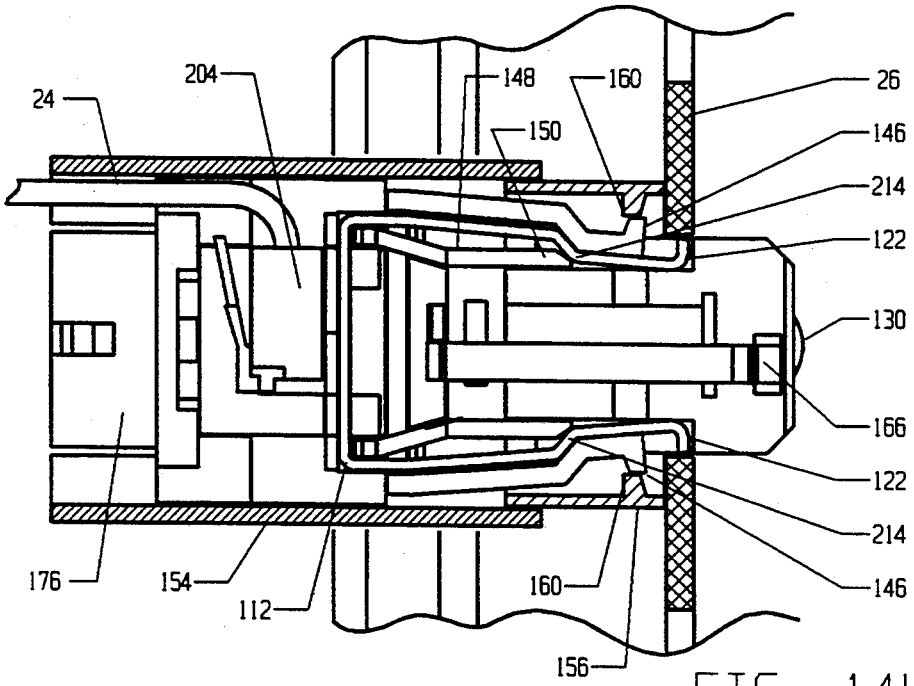

Referring in particular to FIGS. 14*a* and 14*b*, prior to insertion of the tongues 50 into the slots 44, the plunger 156 is in a forwardly extended condition with respect to the connector housing 154. In this condition projections 160 on the inside of the plunger 156 keep the fingers 146 in an inwardly deflected condition, the fingers in turn keeping the hooks 122 of the retaining clips in a retracted condition. Furthermore, the cantilever arm 138 on one side keeps the bus clamp 118 of the other pin housing in a forwardly displaced position, in which a ramp surface 162 of the jaw 166 (FIGS. 5*a* and 5*c*) engages with a corresponding ramp surface 163 formed by the pin housing 103, to keep jaw 166 of the bus clamp in a retracted position (FIG. 14*a*). In this condition, ie with the hooks 122 and the jaws 166 retracted, the tongues 50 can pass freely through the slots 44.

Figure 15A:
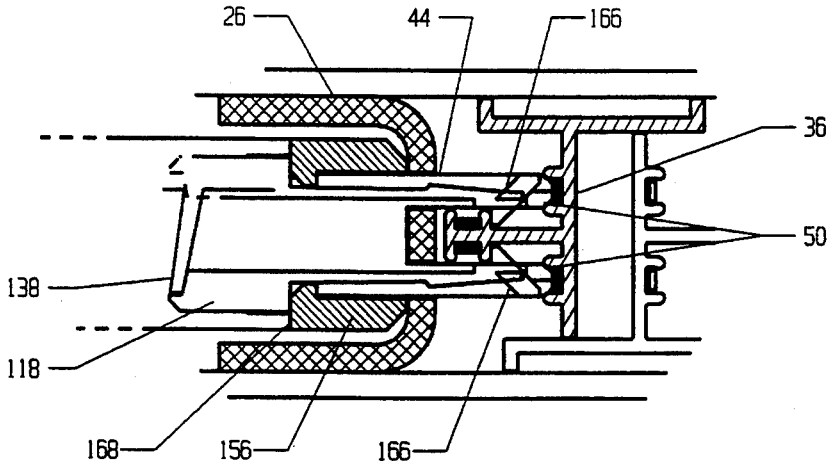
FIGS. 15*a* and 15*b* are horizontal and vertical sections respectively, showing the connector during a second stage of its insertion into the slots.
Figure 15B:
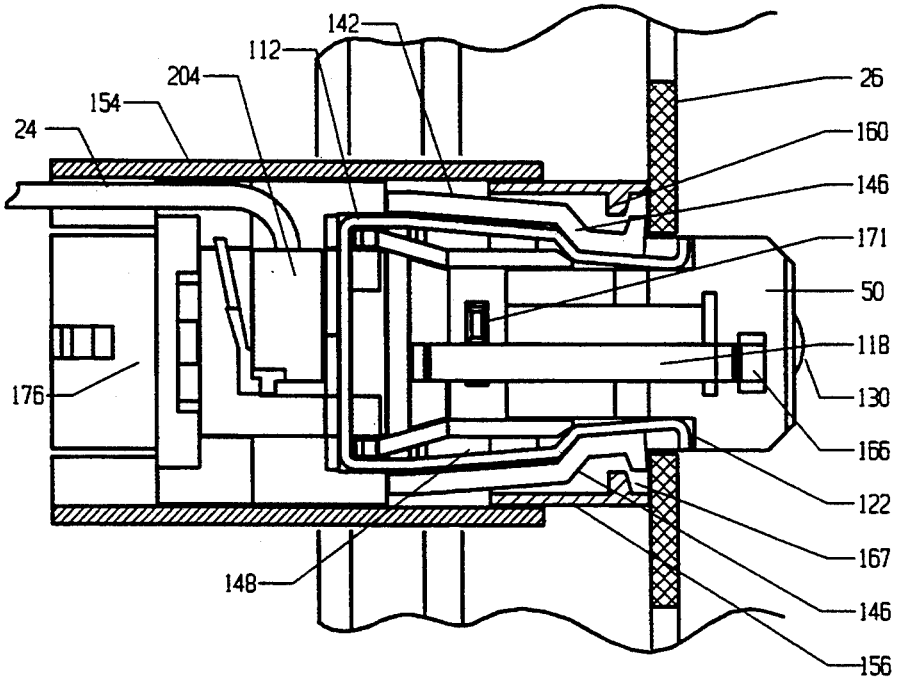
Figure 16A:
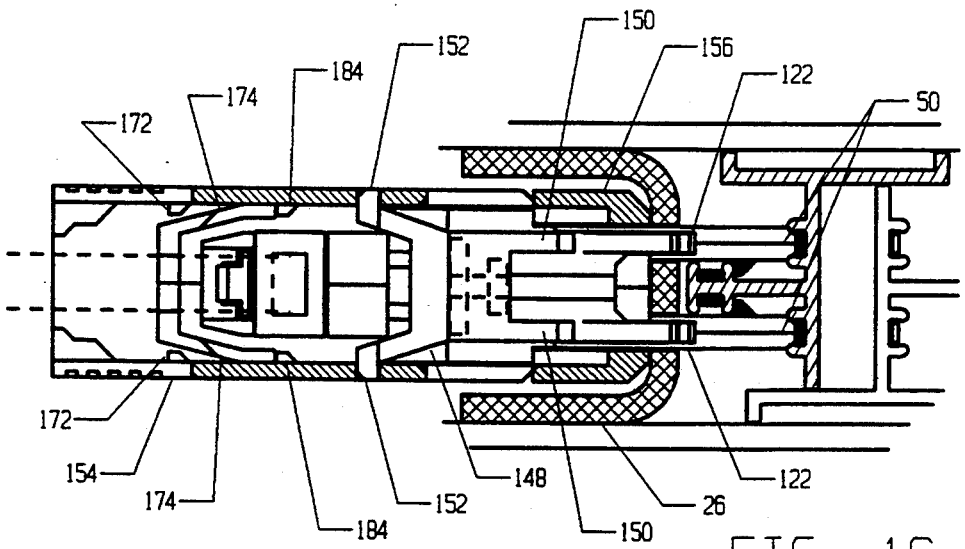
FIGS. 16*a* and 16*b* are different horizontal and vertical sections respectively, showing the connector during the second stage of its insertion into the slots.
Figure 16B:
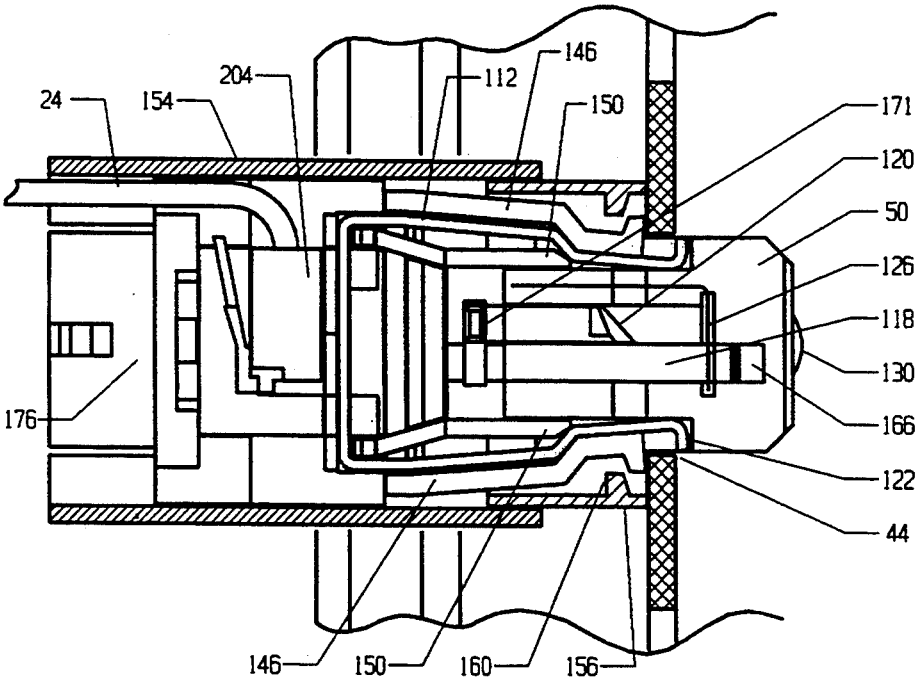
Figure 17A:
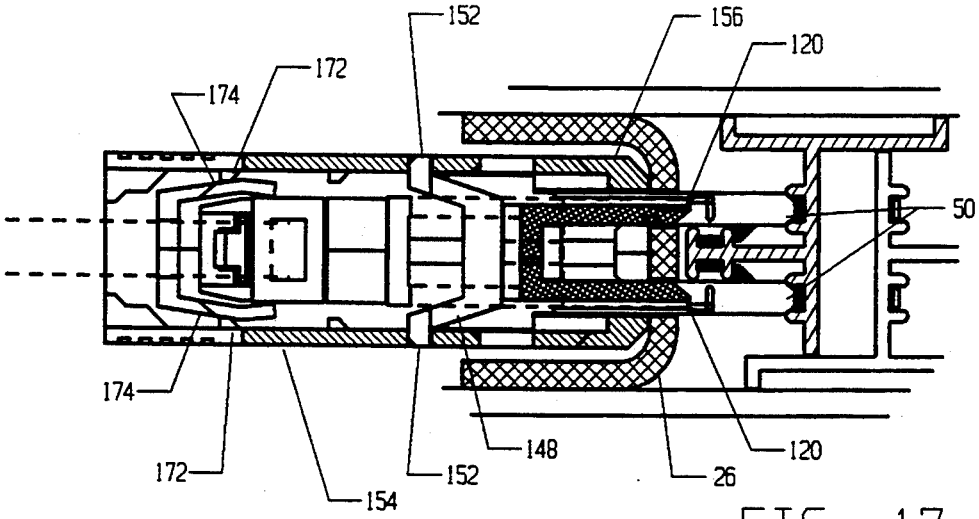
FIGS. 17*a* and 17*b* are horizontal and vertical sections respectively, showing the connector during a third stage of its insertion into the slots.
Figure 17B:
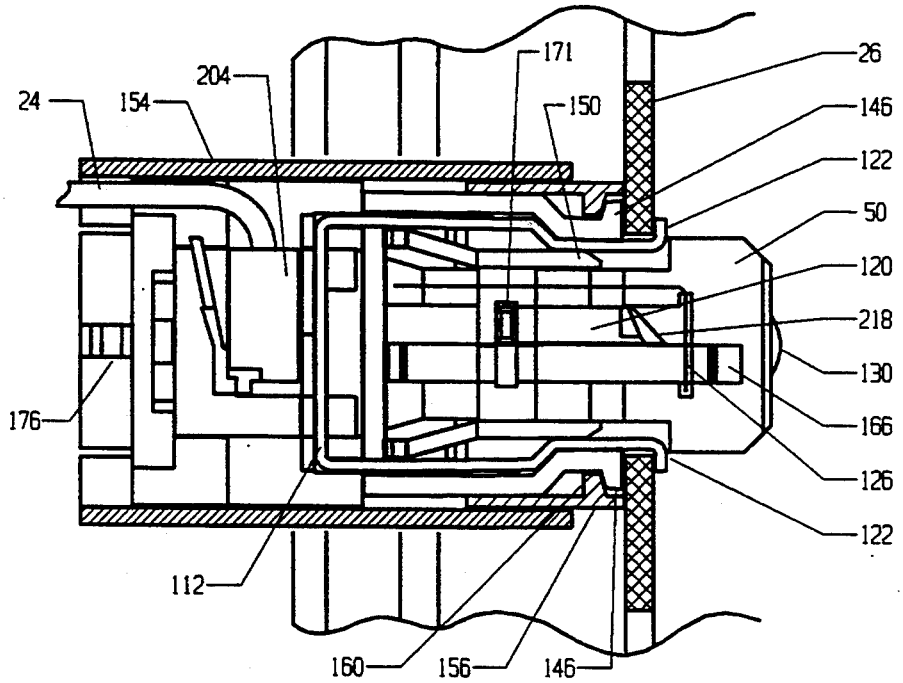

Once the tongues 50 have entered into the slots 44 and forwardly directed face 213 (FIG. 5*b*) of the plunger 156 abuts on the channel 26, the connector housing 154 is pushed further forwards. As the connector housing 154 is coupled to the slide link block 148 ramp formations 214 at the tips of the nose elements 150 butt on corresponding ramp formations 216 (FIGS. 5*a* and 5*c*) of the retaining clips 112. Since the projections 160 hold the limbs of the retaining clips 112 inwardly, the slide link block 148 drives the tongues forwardly with it, via the retaining clips 112 and the spring lock 142. As illustrated in FIG. 15*b*, forward movement of the tongues 50 continues until the front ends of the fingers 146 have slid past the projections 160. The front ends of the fingers 146 can now enter into gaps 167 between the front of each projection 160 and the channel 26. The hooks 122 have by now passed through the slots 44. During the movement to this position the bus clamps 118 remain behind with the plunger 156. This is so because each bus clamp 118 has a step formation 168 (FIG. 5*c*) which engages with the rear face of the plunger 156. As a consequence, the bus clamps 118, whose rear ends engage with the cantilever arms 138, deflect the cantilever arms. Pressure therefore has to be applied to overcome the bias provided by the cantilever arms 138. As the bus clamps 118 move rearwardly with respect to the pin housings 103, the jaws 166 thereof move towards one another (as a result of the ramp surface 162 sliding over the corresponding ramp surface 163 of the pin housing 103) to engage behind shoulders of the conductor tract 36. The terminal portions 130 by now make electrical contact with the corresponding conductors 42.1 and 42.2 of the conductor track 36. The bus clamps 118 and the ends of the cantilever arms 138 move in slots in the pin housings 103. When the ends of the cantilever arms 138 have reached the rear ends of these slots the pin housings 103 are unable to move further forwards with respect to the plunger 156.

Referring in particular to FIGS. 16*a* to 17*b*, the connector housing 154 is pushed forward still further. Not being able to move further forwards, the pin housings 103 remain behind, but the connector housing 154 and the slide line block 148 can now move further forwards. This is so because the retaining hooks 122 are through the slots 44 and the ends of the fingers 146 can enter into the gaps 167. The nose elements 150 thus enter between the limbs of the retaining clips 112 and the pin housings 103, pushing the limbs and also the fingers 146 outwardly to the positions illustrated in FIG. 17*b*. In this condition the retaining hooks 122 engage behind the channel 26 and are locked in this position by the nose elements 150.

Referring in particular to FIGS. 17*a* to 18*b*, the pin wedges 120 move forwardly along with the slide link block 148. This is so because each pin wedge 120 has a transversely extending part 171 which enters in a slot in the slide link block 148. As the connector housing 154 is moved fully forwards until it also abuts on the channel 26, a ramp formation 218 at the forward end of each pin wedge 120 enters behind the corresponding terminal portion 126 and pushes it laterally towards the corresponding conductors 42.3 and 42.4 of the conductor track 36, to establish electrical contact therewith. During this movement each of a pair of catch formations 172 on the inside of the connector housing 154 rides over a ramp surface 174 of the corresponding outer shell 102, the ramp surface being formed on a resiliently deflectable part of the shell, and eventually clips behind the ramp surface as illustrated in FIGS. 18*a* and 18*b*. This locks the connector housing 154 in position with respect to the pin housings 103, so that the connector housing may now be released.

The connector 48 is now firmly in position, the conductor track 36 is located with respect to the connector by means of the jaws 166, and electrical contact is established with each of the four conductors 42.1 to 42.4 of the conductor track 36. In this position the cantilever arms 138 are in a resiliently deflected condition.

To enable the connector 48 to be un-plugged again, the connector housing 154 has slits therein to form it with a pair of wings 176 each of which has an inwardly protruding formation 178, and each of the outer shells 102 is provided with a ramp surface 180 (FIGS. 8 and 9). If it is desired to un-plug the connector 48, the two wings 176 are pressed towards one another. This causes pressure to be applied to the resiliently deflectable part forming the ramp surface 174, deflecting these parts inwardly and so releasing the ramp surface from the catch formation 172. Upon further pressure being applied, the formations 178 engage the ramp surfaces 180, and as a result urge the connector housing 154 rearwardly with respect to the pin housings 103, thereby releasing the catch formations 172 from the ramp surfaces 174. The connector housing 154 can now slide rearwardly with respect to the pin housings 103 until further catch formations 184 on the inside of the connector housing 154 engage behind the ramp surfaces 174. By this time the nose elements 150 will have been withdrawn from between the limbs of the retaining clips 112 and the pin housings 103 and the hooks 122 moved to their retracted positions, and the jaws 166 also moved to their retracted positions. The connector 48 may now be withdrawn completely.

I claim:

1. An electrical connector for making electrical contact with a conductor track through an opening in a support member behind which the conductor track is disposed, the connector comprising:

a tongue which is able to reach through the opening and carries a conductor pin for establishing electrical contact with the conductor track, the tongue being in use inserted in, or withdrawn from, the opening in a first direction; and a jaw carried by the tongue and being displaceable in a second direction transverse to the first direction between a retracted position in which it is retracted in the tongue and an extended position in which it protrudes laterally from the tongue, thereby to engage with the conductor track, the jaw forming part of a bus clamp which is mounted for slidable movement with respect to the tongue in the first direction, a first ramp surface being provided for displacing the jaw from the extended position to the retracted position when the bus clamp is displaced forwardly in the first direction relative to the tongue.

2. An electrical connector according to claim 1, which further comprises biasing means for biasing the bus clamp forwardly with respect to the tongue.

3. An electrical connector according to claim 2, wherein the biasing means is in the form of a resiliently deflectable cantilever arm.

4. An electrical connector according to claim 2, which further comprises a plunger which is displaceable with respect to the tongue in the first direction and has a forwardly directed face adapted to butt on an outer face of the support member when the tongue is in use inserted into the opening, the plunger being coupled to the bus clamp so that rearward displacement of the plunger with respect to the tongue causes rearward displacement of the bus clamp with respect to the tongue, against the bias provided by the biasing means.

5. An electrical connector according to claim 1, wherein the conductor pin has a laterally directed terminal portion, the connector further comprising conductor pin displacement means for displacing the terminal portion from a retracted position in which the terminal portion is retracted in the tongue to an extended position in which the terminal portion protrudes laterally from the tongue.

6. An electrical connector according to claim 5, wherein the conductor pin displacement means is in the form of a pin wedge which is mounted for slidable movement with respect to the tongue in the first direction, a second ramp surface being provided for displacing the terminal portion from the retracted position to the extended position when the conductor pin displacement means is in use displaced forwardly in the first direction with respect to the tongue.

7. An electrical connector according to claim 6, which further comprises a housing which is displaceable with respect to the tongue in the first direction, the housing being coupled to the pin wedge so that forward displacement of the housing with respect to the tongue causes forward displacement of the pin wedge with respect to the tongue.

8. An electrical connector according to claim 7, which further comprises retaining means having a retaining hook for engagement with the support member behind the opening, the retaining hook being displaceable in a third direction transverse to the first direction, and retaining hook displacement means for displacing the retaining hook from a retracted position in which the retaining hook is retracted in the tongue to an extended position in which the retaining hook protrudes laterally from the tongue.

9. An electrical connector according to claim 8, wherein the retaining hook displacement means comprises a slide link block which is mounted for slidable movement with respect to the tongue in the first direction, a third ramp surface being provided for displacing the retaining hook from the retracted position to the extended position when the retaining hook displacement means is in use displaced forwardly in the first direction with respect to the tongue.

* * * * *